US006314786B1

(12) United States Patent
Hofele et al.

(10) Patent No.: US 6,314,786 B1
(45) Date of Patent: Nov. 13, 2001

(54) TRANSFER SYSTEM

(75) Inventors: Hans Hofele, Goepingen; Karl Thudium, Waeschenbeuren; Andreas Dangelmayr, Ottenbach, all of (DE)

(73) Assignee: Schuler Pressen GmbH & Co. KG, Goeppingen (DE)

( * ) Notice: Subject to any disclaimer, the term of this patent is extended or adjusted under 35 U.S.C. 154(b) by 0 days.

(21) Appl. No.: 09/585,579

(22) Filed: Jun. 2, 2000

(30) Foreign Application Priority Data

Jun. 2, 1999 (DE) ..... 199 25 343

(51) Int. Cl.[7] ..... B21D 43/05
(52) U.S. Cl. ..... 72/405.11; 72/405.1; 198/621.1
(58) Field of Search ..... 72/405.1, 405.11, 72/405.16, 405.08, 405.01; 198/621.1

(56) References Cited

U.S. PATENT DOCUMENTS 5,159,827 * 11/1992 Shiraishi ..... 72/405.1
5,383,348 1/1995 Michael .
5,584,205 12/1996 Harsch .
5,722,283 * 3/1998 VanderZee ..... 72/405.1
5,842,370 * 12/1998 Hofele ..... 72/405.09

FOREIGN PATENT DOCUMENTS 27 41 808 3/1978 (DE) .
43 10 057 9/1994 (DE) .
195 06 520 8/1996 (DE) .
1-130827 * 5/1989 (JP) ..... 72/405.1

* cited by examiner

*Primary Examiner*—Daniel C. Crane
(74) *Attorney, Agent, or Firm*—Crowell & Moring LLP

(57) ABSTRACT

A transfer system, particularly for a press facility, has a guiding device on which workpiece holding devices are longitudinally displaceably disposed which belong to two different groups. The longitudinal displacement takes place by way of a driving device which is carried at least partially by the guiding device.

17 Claims, 4 Drawing Sheets

TRANSFER SYSTEM

BACKGROUND OF THE INVENTION

This application claims priority of 199 25 343.9, filed on Jun. 2, 1999, the disclosure of which is expressly incorporated by reference here.

The present invention relates to a transfer system. The transfer system according to the invention is used particularly for workpiece transport in forming machines, such as transfer presses or other machines, where workpieces must be guided through several machining stations.

As a rule, forming machines, such as large-part transfer presses (vehicle body presses) have a succession of machining stations, such as press stages, through which the workpieces pass successively. They experience another deformation in each station along their path, so that the desired end product is created in steps. The overall machining time of a workpiece is composed of the times required for the workpiece forming as well as the transport times. The productivity of a press system or other machine can be increased if its output, that is, the number of parts produced per time unit, is raised. If the stroke rate is increased for this purpose in the case of a press, that is, the rotational speed of the main press drive is raised, the transport times cannot remain unchanged but decrease correspondingly.

Sheet metal parts to be moved in large-piece transfer presses are frequently relatively large. In the transport direction, they may be 1 m to 2 m long and, transversely to the transport direction, may be over 4 m wide. Together with corresponding workpiece holding devices, the total mass is therefore considerable, which must be accelerated and braked during the transport from one tool to the next. In this case, the paths to be covered are within the range of several meters; in the case of press systems with intermediate depositing devices, for example, at 2 m to 3 m. However, the workpiece transport can take place only in a very narrow time window; that is, the transfer movement must be coordinated relatively precisely to the work of the remaining press system.

When designing press systems, care must be taken that the press system can also be used for future vehicle body designs (or other shapes of parts). It should therefore be expected that tools are used in the press whose precise construction is still unknown at the point in time of the manufacturing of the press system. Correspondingly, it may be required to adapt the transfer movement when setting up the press or when retooling to the changing conditions.

DE 2741808 discloses a transfer device for transfer presses having two transport rails extending at a distance in parallel to one another along several stations. The transport rails can be lifted and lowered, for which lifting mechanisms are used which are driven by electric motors arranged at the end side. A longitudinal movement of the gripper rails is caused by electric motors arranged on a base frame and acting upon toothed racks connected with the gripper rails. A longitudinal movement of the toothed racks is therefore transmitted to the gripper rails. The transfer curve, which is achieved by superimposing a lifting movement with the transfer movement, is achieved by an electronic sequence switching which controls the motors starting from mechanical curves. Between the driving motors and the moved transfer rails, power transmitting devices, which have an inert mass, are required.

Furthermore, a three-axis transfer device is described in DE 4310057 A1 for the transport of workpieces in transfer presses. Two transfer rails, which are spaced at a distance parallel to one another, are used for the workpiece transport. The transfer rails are moved toward one another and away from one another for picking up and depositing the workpieces. They can be lifted and lowered and can be moved in the transport direction for causing the transport. Electric motors are used for driving all movements. The electric motors causing the transfer step are arranged on a fixed base frame which is arranged outside the machining (forming) stations. The base frame carries drive units which have a slide as an output which is displaceably disposed on a linear guide. This slide is connected with the respective assigned gripper rail by way of a connecting rod, so that the longitudinal movement of the gripper rail can be determined by the movement of the slide but it can be lifted and lowered independently thereof.

The inert masses to be taken into account for determining the overall dynamics also contain parts arranged outside the gripper rails, such as slides and connecting rods, which are used for the connection between the gripper rails and the drive units.

DE 19506520 A1 discloses a transfer device which is constructed as a two-axle transfer. Travelling carriages are longitudinally displaceably disposed on spaced parallel guide rails through a press system. A suction bridge is in each case arranged between two travelling carriages and has the purpose of temporarily receiving a workpiece and carrying it away. The suction bridges are assigned to two different groups. The suction bridges of the first group travel through a slightly different transfer curve than the suction bridges of the second group. They differ with respect to their longitudinal movement. Correspondingly, two stationarily disposed transfer drive units are provided. The first transfer drive unit has a vertically aligned linear guide which has a drive unit generating a linear movement for adjusting the position of the gripper devices, the drive unit being moved back and forth in the transfer direction. A slide provided on the linear guide is connected with a connecting rod driving the suction bridges which are assigned to the corresponding drive unit. A corresponding arrangement is provided for the drive of the suction bridges of the other group. In addition to moving the suction bridges and the connecting rods, the transfer drive units must also move the linear guides.

SUMMARY OF THE INVENTION

An object of the present invention is to provide a transfer system and a construction which permits improved dynamics.

This object has been achieved by the transfer system having a guiding device which carries at least one first workpiece holding device and at least one second workpiece holding device in each case independently of one another in a longitudinally displaceable manner, which workpiece holding devices are set up for, in each case, receiving and releasing in a controlled manner at least one workpiece. A first driving device is assigned to the first workpiece holding device in order to move this workpiece holding device along a path defined by the guiding device for causing the workpiece transport, and a second driving device is assigned to the second workpiece holding device in order to move this workpiece holding device, for causing the workpiece transport, along the path defined by the guiding device independently of the first workpiece holding device. The first driving device and the second driving device are carried by the guiding device.

The transfer system according to the present invention has a guiding device so that at least two workpiece holding devices independently of one another are disposed to be displaced in the transfer direction. The workpiece holding devices may, for example, be suction bridges. The guiding device is formed by two spaced parallel guide rails. The transfer direction will then coincide with the longitudinal direction of the rail, and the path defined by the guiding device is a straight line.

As an alternative to the guide rails, at which two groups of workpiece holding devices are disposed each containing one workpiece holding device, several guiding elements may also be provided. The workpiece holding devices may, for example, be fastened on a rail which is longitudinally displaceably disposed in guiding elements. The guiding elements may, for example, contain the stators of linear motors or other drives for the movement of the rails.

The guiding device carries at least two driving devices in order to be able to move the at least two workpiece holding devices independently of one another in the guiding direction. The arrangement of the driving devices on the guiding device has important advantages for the transfer system. The driving connection between the driving devices and the workpiece holding devices can be extremely brief and take place without any horizontal uncoupling. For example, any connecting rods, linear guides or other devices can be eliminated, which are otherwise required in stationarily disposed transfer driving devices if the guiding rail or other guiding device is to be vertically adjusted. As a result, the dynamics of the transfer system can be improved with respect to the transfer movement. The moved inert masses can be minimized.

The present invention also has other advantages. A vertical adjustment of the guiding device, for example, can take place without any problem. The driving devices for the transfer step are simply taken along by the guiding device. The guiding rails can, for example, be moved upward in order to permit an unhindered tool change. The guide rails, which are otherwise situated beside the tools, will then permit that the sliding tables, on which the tools are deposited, can be moved laterally out of the press stations.

Another advantage of the arrangement of the driving devices according to the invention on or at the guiding device permits an unhindered lifting and lowering stroke when passing through a transfer curve. The driving devices are lifted and lowered with the guiding device.

Independently thereof, the workpiece holding devices of the first and of the second group can travel through different transfer curves. This takes place while the basic structure of the transfer system is mechanically simple. In this manner, during the removal from the tools, the workpieces are permitted to be moved, for example, on different curves than when the workpieces are placed in the tools. The two transfer curves or paths can therefore be optimized separately from one another.

The guiding device and the driving devices carried by the guiding device can be understood to be separate constructional units which can be designed largely independently of other conditions on the forming machine. No base frames are to be provided in front of or behind the transfer press system on which the transfer drives would have to be arranged. The transfer system according to the invention, for example, comprises an embodiment in which travelling carriages are provided on a transfer rail which, in groups, are connected with one connecting rod respectively. The connecting rods are connected at least at one end, for example, by a longitudinally adjustable strut, with an exterior fixing point. In or on the longitudinally adjustable strut, a drive will then be arranged which is part of the driving device.

The driving device can also, however, be carried completely by the guiding device. No exterior fixing point will then be required on which the driving device would have to be separately supported. The reaction forces of the driving device, which arise during the acceleration and deceleration of the workpiece holding devices, are first transmitted to the guiding device and are transmitted by the latter, for example, to the press stands or, if lifting units are provided, are transmitted by way of the lifting units to the press stands. The driving reaction forces are introduced and therefore diverted in this manner along the short path directly into the press stands. Incorrect positioning because of possible different movements between a separate frame for the drives and the presses is therefore avoided.

The transfer movement can be derived from one or several drive units. Advantageously, workpiece holding devices, such as suction bridges, which are disposed on the end side on corresponding carrying elements, such as travelling carriages, are connected with one another by connecting rods. These are preferably connected directly with the travelling carriage. In this case, the drive units can be provided at particularly suitable points of the guiding device. These are, for example, the ends. As a result of the corresponding distribution of the drive units along the length of the guide rail, the weight load at all suspension points of the guide rail or other guiding devices can be adapted with respect to one another. Possible lifting units are therefore subjected to a concurrent loading. The connecting rods can also be interrupted so that the drive groups each have a drive. The synchronizing of the drives of different drives groups, which are to be moved synchronously, will then take place electrically.

The workpiece holding devices, preferably suction spiders, may be rigidly connected to cross traverses. Preferably, however, they can be swivelled by controlled drives about a transverse axis (tilting axis) and/or can be laterally moved. Thus, a positioning can take place during the workpiece transport.

For the transfer system, one or several intermediate depositing devices which have one or several axes can be used. For example, workpiece supports can also be linearly adjustable in one or several directions and can be disposed to be swivellable about one or several axes and can be provided with corresponding drives. This permits a superimposed control device to control the movements of the workpiece holding devices as well as the movements of the workpiece depositing devices in a targeted and coordinated manner. The setting of desired movement curves can take place by programming.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
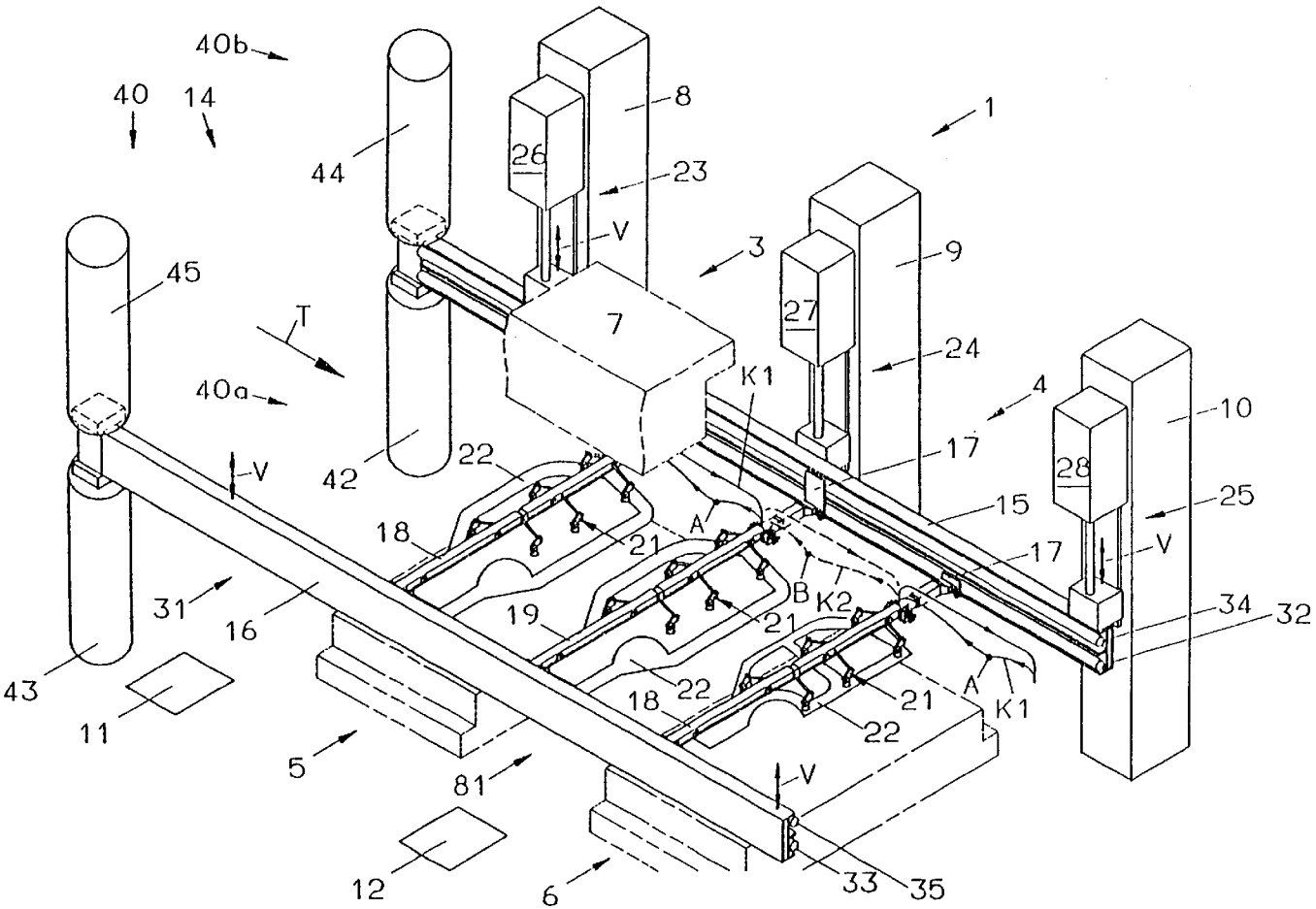
FIG. 1 is a schematic perspective, partially sectional view of a press facility having a transfer system according to the invention.

FIG. 1 is a schematic view of a press facility 1 including two machining stations 3, 4 which follow one another in the transfer direction T. These are each part of press stations with sliding tables 5, 6, on which tool bottom parts (not illustrated in detail) are disposed. A tool top part is assigned to each tool bottom part, the tool top parts each being fastened to a slide which is illustrated in a fragmented manner only for press station 3. The individual press stations 3, 4 are, in addition, symbolized in FIG. 1 by their press stands 8, 9, 10, which are, in each case, vertically arranged on one side of the press facility 1 behind one another in the transport direction T. The press stands arranged on the opposite side are illustrated only schematically by their horizontal projections 11, 12.

In order to transport a workpiece through the press facility 1, a transfer system 14 which includes two guide rails 15, 16 extends in the direct vicinity of the press stands 8, 9, 10 and the opposite press stands 11, 12 in the transport direction T horizontally through the press facility 1. Travelling carriages 17 are disposed on the guide rails 15, 16. In pairs, they each hold a suction bridge 18, 19. The suction bridges 18, 19 are formed by carriers extending transversely to the transport direction T, from which carriers, on corresponding extension arms, suction devices project away as workpiece holding devices 21. In each case, these form a suction spider for the temporary receiving and holding of sheet metal parts or vehicle body parts.

The suction bridges 18, 19 may have a rigid construction and fixedly connect the travelling carriages 17 with the workpiece holding devices 21. If required, however, the workpiece holding devices can also be held on the suction bridges 18, 19 in a swivellable or displaceable manner by way of controlled drives.

The guide rails 15, 16 are carried by lifting units 23, 24, 25 which have identical constructions and adjust the guide rails 15, 16 in the vertical direction V. For this purpose, linear guides are disposed on the stands 8, 9, 10 and can be vertically adjusted by lifting drive units 26, 27, 28. The vertical adjustment can achieve, by superimposition with a movement of the suction bridges 18, 19, transfer curves K1, K2 desired in the transport direction T, as well as of moving the guide rails 15, 16 in the upward direction, for example, for the purpose of a tool change. In individual cases, if the transfer curves K1, K2 contain no vertical component, correspondingly simply constructed lifting drive units 23, 24, 25 can be used only for adjusting a desired working height.

The guide rails 15, 16 together form a guiding device 31 for the workpiece holding devices 21 which are guided on the guide rails 15, 16 by way of the suction bridges 18, 19 and the travelling carriages 17. The workpiece holding devices 21 are alternately assigned to different groups. By way of their workpiece holding devices 21, the suction bridges 18 travel through the transfer curve K1, while the workpiece holding devices 21, which are disposed on the suction bridges in FIG. 1 represented by only a single suction bridge 19, travel through the transfer curve K2. The travelling carriages 17 of the suction bridges 18 of the first group are connected with one another by connecting rods 32, 33. The travelling carriages 17 of the suction bridges 19 are correspondingly connected with one another by connecting rods 34, 35. The connecting rods 32, 33, 34, 35 are longitudinally displaceably guided on the guide rails 15, 16 in that they are connected, for example, with the travelling carriages 17.

Figure 2:
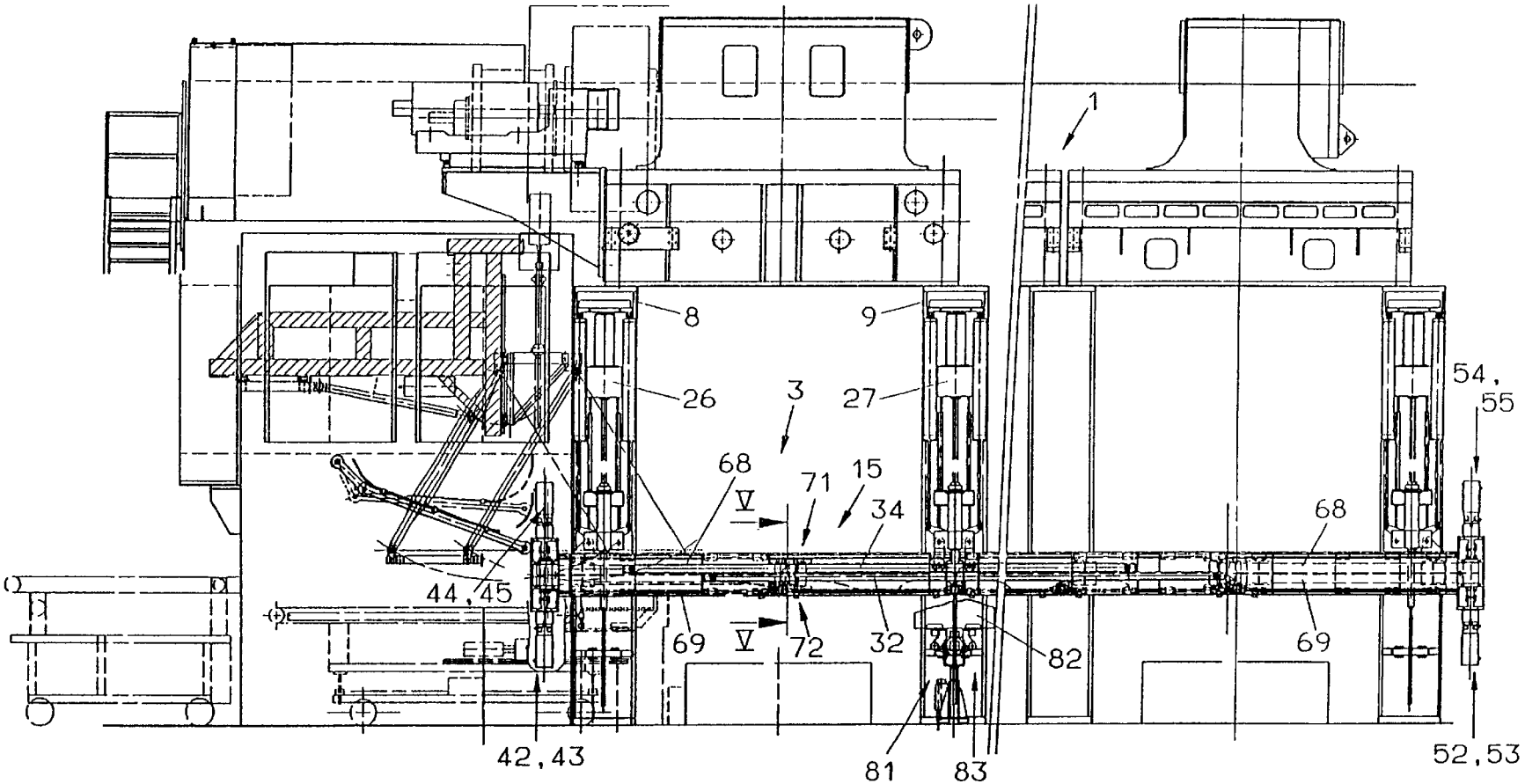
FIG. 2 is a schematic lateral partially sectional view of the press facility according to FIG. 1.

The guide rails 15, 16 carry a transfer drive 40 with a first driving device 40*a* and a second driving device 40*b*. The transfer drive 40 is formed by drive units 42, 43, 44 on one end respectively of the guide rails 15, 16 as well as by additional drive units 52, 53, 54, 44, as illustrated by FIG. 2, on the opposite end of each guide rail 15, 16.

All drive units 42 to 55 are formed by geared motors (servo motors) which, by way of corresponding transfer gears, generate a linear movement to be transmitted directly to the connecting rods 32, 33, 34, 35. The drive units 42, 52 of the first driving device 40*a* are connected with the connecting rod 32. Also, the drive units 43, 53 of the first driving device 40*a* are connected with the connecting rod 33; the drive units 44, 54 of the second driving device 40*b* are connected with the connecting rod 34; and the drive units 45, 55 also of the second driving device 40*b* are connected with the connecting rod 35. Two drive units are therefore assigned to each connecting rod 32, 33, 34, 35 and are connected with the beginning and the end of each connecting rod 32 to 35.

The housings of the drive units 42 to 55 are connected with the guide rails 15, 16 and are therefore supported on the latter. The guide rails 15, 16 correspondingly transmit the acceleration force to be applied by the drive units 42 to 55 to the press stands 8, 9, 10 (as well as the additional, not illustrated press stands). In this case, as the result of its inherent inertia, the mass of the guide rail absorbs a portion of the force. The inert mass of the guide rails 15, 16 therefore slightly buffers possible impulses which may be caused by the drive units 42 to 55. However, in each case, the position of the transfer device 14 is clearly determined also in the transport direction T by the press stands 8, 9, 10, which promotes the precision of the transfer movement and of the parts transfer.

Figure 3:
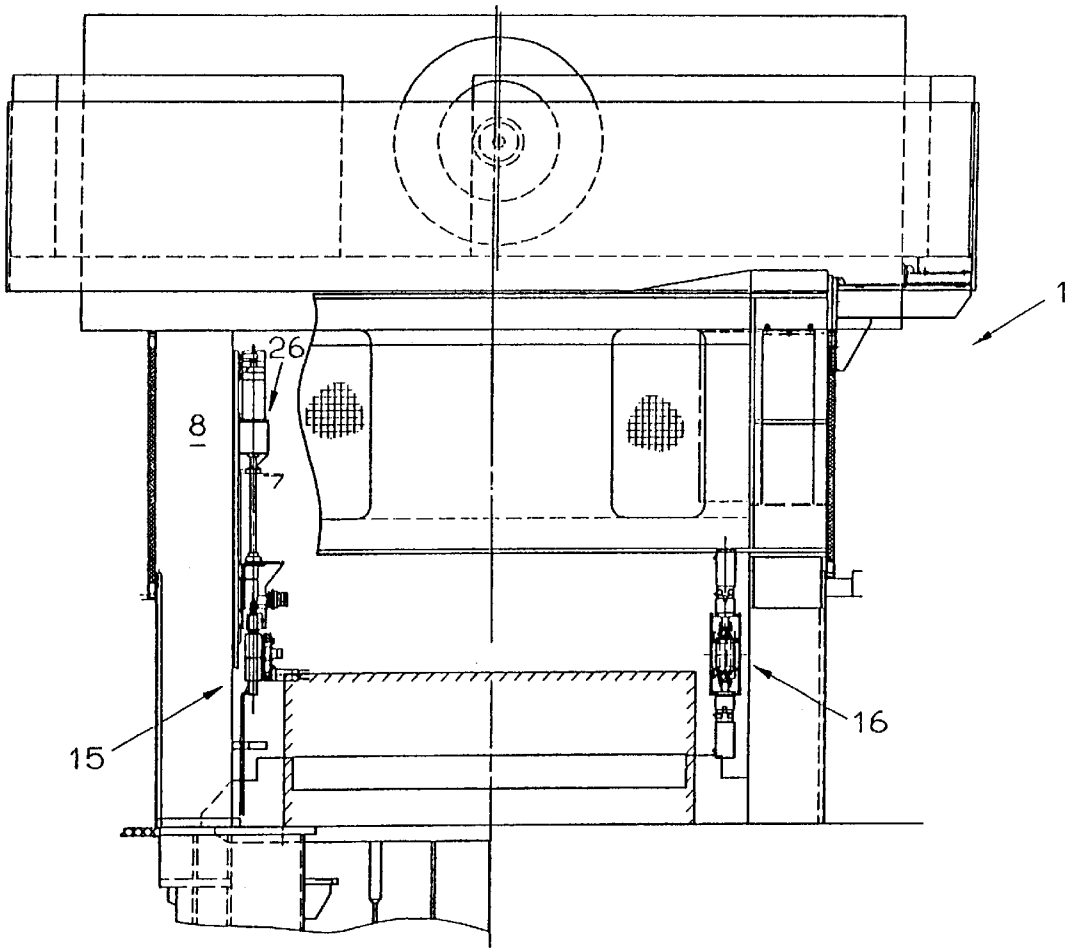
FIG. 3 is a frontal view of the press facility according to FIGS. 1 and 2.

As illustrated in FIG. 3, the lifting unit 26 (as well as lifting units 27, 28) can be arranged above the guide rails 15, 16. If required, however, they can just as well be disposed below the guide rails 15, 16 on the press stands 8, 9, 10 or at other suspension points. It is important that, for example, for the tool change, the guide rails 15, 16 can be moved to a level which, permits the passage of the tools under the guide rails 15, 16 when the sliding tables move laterally out of the press facility 1.

Figure 4:
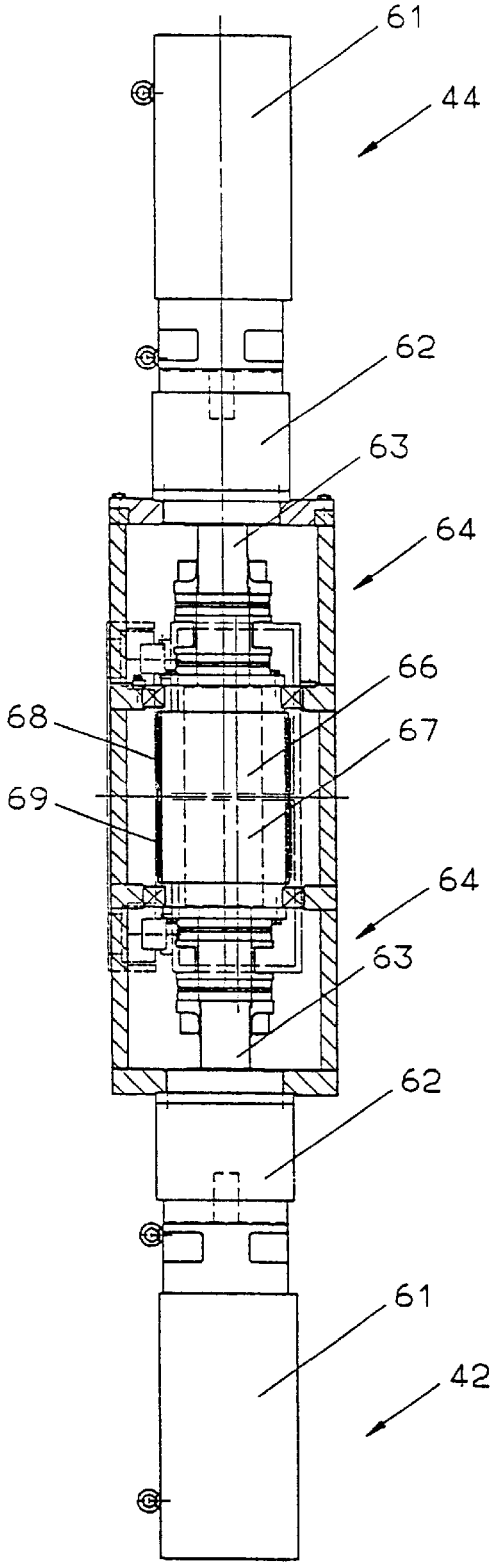
FIG. 4 is a sectional view of a guide rail of the transfer system with transfer drives carried by the guide rail.
Figure 5:
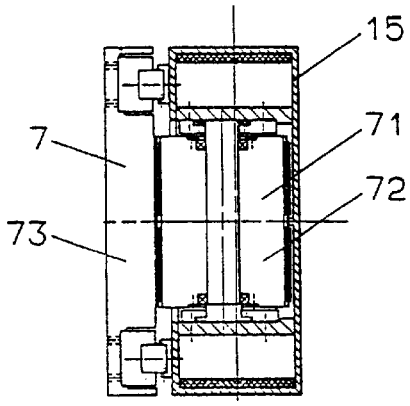
FIG. 5 is a sectional view along line V-Vof FIG. 2 of the transfer rail shown in FIG. 4.

In FIGS. 4 and 5, the guide rail 15 is illustrated separately in a sectional view. In FIG. 4, the section takes place through the drive units 42, 44 which are constructed corresponding to the other drive units 43, 45, 52, 53, 54, 55. Servo motors 61 with a flanged-on gear 62 and a corresponding position measuring sensor system form the drive source whose output 63 projects into the interior of a gear box 64. Here, the output shafts 63 are connected with toothed-belt pulleys 66, 67 on which toothed belts 68, 69 travel. These are illustrated in FIG. 2. They extend into the guide rail 15 and are guided at a distance from the drive units 44, 42 around an additional pulley 71, 72. This distance is larger than the length of the transfer step. A driving device 73, 74 is in each case fastened on the toothed belt 68, 69 and is connected with the respective connecting rod 32, 34.

As illustrated only schematically in FIG. 2, depositing devices 81 are arranged between two press stands respectively. The depositing devices 81 carry a workpiece depositing part 82 at their upper end. This depositing part 82 is carried by an adjusting device which permits a movement of the workpiece depositing part 82 in one or several directions as well as a swivelling of the workpiece depositing part 82 in one or several directions. If required, however, the depositing device 81 may have a passive construction, that is, without any active adjustment.

If adjusting possibilities exist (i.e., if the workpiece depositing part 82 can, for example, in a targeted manner, be lifted, lowered, adjusted in the transverse direction, moved into the transport direction T and be tilted or swivelled about one or several axes) the corresponding swivelling drives, such as the lifting units 26, 27, 28 and the driving device 40, are subjected to a transfer control which can control all axes independently of one another. As a result, the transfer movement of the workpiece holding devices 21 can be adapted not only to the work of the press facility (i.e., the movement of the press slides 7) but also to the movements of the workpiece depositing parts 82.

In operation of the press system 1, the slides 7 of the press are lifted and lowered in a timed manner by a main drive. In the process, the tools open up in that the tool top parts are each placed onto the workpieces situated on the tool bottom part; the tools form these workpieces and lift off again. While the tool top parts move upward, i.e., the tools open up, the transfer units 42, 43, 52, 53 are controlled so that, starting from a parked position A, the suction bridges 18 move into their position illustrated in FIG. 1 for receiving the workpieces 22. The lifting drive units 26, 27, 28 are controlled at this point such that the branch of the transfer curve K1 is created which starts out from the parked position A. Simultaneously, the transfer units 44, 45, 54, 55 are controlled such that the suction bars 14 move out of their parked position B into the position illustrated in FIG. 1 above the depositing device 81 arranged here. The workpiece 22 situated here is to be picked up.

When all workpieces 22 are held by the suction spiders, the lifting drive units 26, 27, 28 and the drive units 42 to 55 of the driving device 40 are controlled such that a travelling through the upper branches of the transfer curves K1 and K2 takes place. As a result, the workpieces 22 are moved out of the tools to the intermediate depositing devices and out of the intermediate depositing devices to the tools. The workpieces 22 are deposited here, after which the suction bridges 18, 19 move back into their respective parked position A, B.

During the lifting and lowering of the guide rails 15, 16, the drive units 42 to 55 of the driving device 40 are also lifted and lowered. The only connection between the transfer device 14 and the press system 1 are the lifting drive units 26, 27, 28 as well as the other lifting units which are not shown.

In summary, a transfer system 14, particularly for a press facility 1, has a guiding device 31 on which workpiece holding devices 21 are longitudinally displaceably disposed which belong to two different groups. The longitudinal displacement takes place by way of a driving device 40 which is carried at least partially by the guiding device 31.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Transfer system for transporting workpieces in forming machines, which include transfer presses, comprising:

a guiding device which carries at least one first workpiece holding device for carrying a first workpiece and at least one second workpiece holding device for carrying a second workpiece independently of one another along different transfer curves in a longitudinally displaceable manner, the workpiece holding devices being operatively configured for controllably receiving and releasing at least one workpiece, a first driving device which is operatively assigned to the at least one first workpiece holding device to move the latter along a path defined by the guiding device and transporting the workpiece, and a second driving device which is operatively assigned to the at least one second workpiece holding device to move the latter to transport the workpiece along a path defined by the guiding device independently of the at least one first workpiece holding device, wherein the first driving device and the second driving device are operatively carried by the guiding device.

2. Transfer system according to claim 1, wherein the first and second driving devices are operatively connected with the guiding device for supporting applied driving forces.

3. Transfer system according to claim 1, where the guiding device defines a straight path for the at least one first and second holding devices.

4. Transfer system according to claim 1, where the guiding device comprises a guide rail or a plurality of parallel guide rails, on which carrying elements, which comprise the at least one first and second workpiece holding devices, are longitudinally displaceably disposed which are part of the workpiece holding devices.

5. Transfer system according to claim 4, wherein the carrying elements are arranged to be moved synchronously and are mechanically coupled with one another.

6. Transfer system according to claim 1, wherein the guiding device extends through at least several work stations of a multistation forming machine substantially horizontally and is arranged to be vertically adjustable.

7. Transfer system according to claim 1, wherein the guiding device is carried by at least one lifting unit which is operated in a time-coordinated manner with respect to the first and second driving devices.

8. Transfer system according to claim 1, wherein each driving device has at least one mutually coupled drive unit.

9. Transfer system according to claim 8, wherein the at least one drive unit is arranged on ends of the guiding device.

10. Transfer system according to claim 1, wherein the first and second driving devices each contain at least one direct drive.

11. Transfer system according to claim 1, wherein a rigid connection is provided between, on one hand, the first and second driving devices and, on the other hand, the at least one first and second workpiece holding devices with respect to the moving direction defined by the first and second driving devices.

12. Transfer system according to claim 1, wherein the at least one first and second workpiece holding devices include a swivelling axis.

13. Transfer system according to claim 1, wherein the at least one first and second workpiece holding devices are comprised of a displacement axis at a right angle with respect to a direction defined by the first and second driving devices.

14. Transfer system according to claim 1, wherein transfer system comprises at least one depositing device operatively arranged between two machining stations of the forming machine.

15. Transfer system according to claim 1, wherein the depositing device comprises a workpiece depositing part arranged to be adjusted in at least one direction by a corresponding at least one adjusting drive for swivelling or displacing the workpiece depositing part in different directions.

16. Transfer system according to claim 1, wherein the first and second driving devices and the at least one adjusting drive of the depositing device are arranged to be controlled by a computer control unit which defines for both workpiece holding devices one programmable transfer curve respectively and a take-over and positioning movement for the depositing device.

17. Transfer system according to claim 16, wherein the depositing device comprises a workpiece depositing part arranged to be adjusted in at least one direction by a corresponding at least one adjusting drive for swivelling or displacing the workpiece depositing part in different directions.

* * * * *